US006997310B1

(12) United States Patent
Fenley

(10) Patent No.: US 6,997,310 B1
(45) Date of Patent: Feb. 14, 2006

(54) SCHOOL DOCUMENT STORAGE SYSTEM

(76) Inventor: Stacey E. Fenley, 836 Espanola Way, Miami Beach, FL (US) 33139

( * ) Notice: Subject to any disclaimer, the term of this patent is extended or adjusted under 35 U.S.C. 154(b) by 111 days.

(21) Appl. No.: 10/664,669

(22) Filed: Sep. 17, 2003

(51) Int. Cl.
*A45C 11/34* (2006.01)

(52) U.S. Cl. ..... 206/214; 206/425; 206/459.5

(58) Field of Classification Search ..... 40/312; 150/119; 206/214, 215, 232, 425, 459.5; 229/77, 78.1, 78.2, 125.39, 125.41, 141, 229/148

See application file for complete search history.

(56) References Cited

U.S. PATENT DOCUMENTS

| | | | | |
|---|---|---|---|---|
| 215,248 | A | 5/1879 | Shipman | |
| 1,487,014 | A * | 3/1924 | Davis | 206/459.5 |
| 1,610,354 | A * | 12/1926 | Brown | 190/102 |
| 2,333,798 | A * | 11/1943 | Kner | 206/425 |
| 3,058,583 | A * | 10/1962 | Williams | 206/425 |
| 4,542,777 | A | 9/1985 | Benson | 150/52 |
| 4,790,434 | A | 12/1988 | Schoberg et al. | 206/387 |
| 4,871,066 | A | 10/1989 | LaWall | 206/425 |
| 5,014,850 | A | 5/1991 | Huff | 206/371 |
| 5,350,045 | A | 9/1994 | Robertson | 190/110 |
| 5,515,972 | A | 5/1996 | Shames | 206/425 |
| 5,741,028 | A | 4/1998 | Hatano et al. | 281/45 |
| 6,012,557 | A | 1/2000 | Derelanko | 190/108 |
| 6,044,879 | A * | 4/2000 | Ray | 150/119 |
| 6,431,357 | B1 * | 8/2002 | Su | 206/425 |
| 6,672,439 | B1 * | 1/2004 | Platte, III | 206/425 |
| 2001/0030137 | A1 * | 10/2001 | Ishii et al. | 206/425 |
| 2003/0116461 | A1 * | 6/2003 | Colloton | 206/425 |

FOREIGN PATENT DOCUMENTS

| | | |
|---|---|---|
| WO | WO 90/05643 | 5/1990 |

* cited by examiner

*Primary Examiner*—Mickey Yu
*Assistant Examiner*—Jerrold Johnson

(57) ABSTRACT

A school document storage system for providing efficient and organized storage of a child's school documents based upon grade level. The school document storage system includes an outer housing having a cover member, and a plurality of inner compartments removably positioned within an interior of the outer housing. A transparent pocket is preferably positioned within the front portion of the outer housing for receiving a picture or other display item. A plurality of closure apertures are within the cover member that removably receive closure members attached to the upper sides of the outer housing. The cover member preferably has an upper member, a front member extending from the upper member and a pair of side members extending from the upper member.

1 Claim, 7 Drawing Sheets

SCHOOL DOCUMENT STORAGE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to document retaining devices and more specifically it relates to a school document storage system for providing efficient and organized storage of a child's school documents based upon grade level.

2. Description of the Related Art

Storage devices have been in use for years. Typically, storage devices are comprised of a single compartment that has a removable cover (e.g. cardboard shipping boxes, multi-use containers).

The main problem with conventional storage devices is that they do not efficiently organize and store school documents (e.g. artwork, schoolwork, report cards, awards, etc.) based upon the grade of the child. Another problem with conventional storage devices is that they are not easily accessible and do not encourage the saving of school documents at the time the documents are received by parents. A further problem with conventional storage devices is that they do not protect the documents from water, dirt and other debris. A further problem with conventional storage devices is that they do not provide a system for efficiently storing and retrieving school documents based upon school year. Another problem with conventional storage devices is that they are not acid free or of archival quality. A further problem with conventional storage devices is that they are not large enough to accommodate large sheets of paper commonly utilized in school art projects. Another problem with conventional storage devices is that they are typically not attractive nor do they appeal to children.

While these devices may be suitable for the particular purpose to which they address, they are not as suitable for providing efficient and organized storage of a child's school documents based upon grade level. Conventional storage devices do not provide a system for effectively storing in a separate manner all of the years a child attends school.

In these respects, the school document storage system according to the present invention substantially departs from the conventional concepts and designs of the prior art, and in so doing provides an apparatus primarily developed for the purpose of providing efficient and organized storage of a child's school documents based upon grade level.

BRIEF SUMMARY OF THE INVENTION

In view of the foregoing disadvantages inherent in the known types of storage devices now present in the prior art, the present invention provides a new school document storage system construction wherein the same can be utilized for providing efficient and organized storage of a child's school documents based upon grade level.

The general purpose of the present invention, which will be described subsequently in greater detail, is to provide a new school document storage system that has many of the advantages of the storage devices mentioned heretofore and many novel features that result in a new school document storage system which is not anticipated, rendered obvious, suggested, or even implied by any of the prior art storage devices, either alone or in any combination thereof.

To attain this, the present invention generally comprises an outer housing having a cover member, and a plurality of inner compartments removably positioned within an interior of the outer housing. A transparent pocket is preferably positioned within the front portion of the outer housing for receiving a picture or other display item. A plurality of closure apertures are within the cover member that removably receive closure members attached to the upper sides of the outer housing. The cover member preferably has an upper member, a front member extending from the upper member and a pair of side members extending from the upper member.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a school document storage system that will overcome the shortcomings of the prior art devices.

A second object is to provide a school document storage system for providing efficient and organized storage of a child's school documents based upon grade level.

Another object is to provide a school document storage system that preserves school documents for a child in an organized and structured manner.

An additional object is to provide a school document storage system that provides efficient access to school documents.

A further object is to provide a school document storage system that increases the child's pride in their schoolwork.

Another object is to provide a school document storage system that may receive various sizes of school documents.

Another object is to provide a school document storage system that is acid free and of archival quality.

Another object is to provide a school document storage system that is sufficient in size to receive large school documents without requiring folding of the same.

Another object is to provide a school document storage system that is attractive and appeals to school children to assist them in taking pride in their work.

Another object is to provide a school document storage system that is stores the important works of a child's school career in one location.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
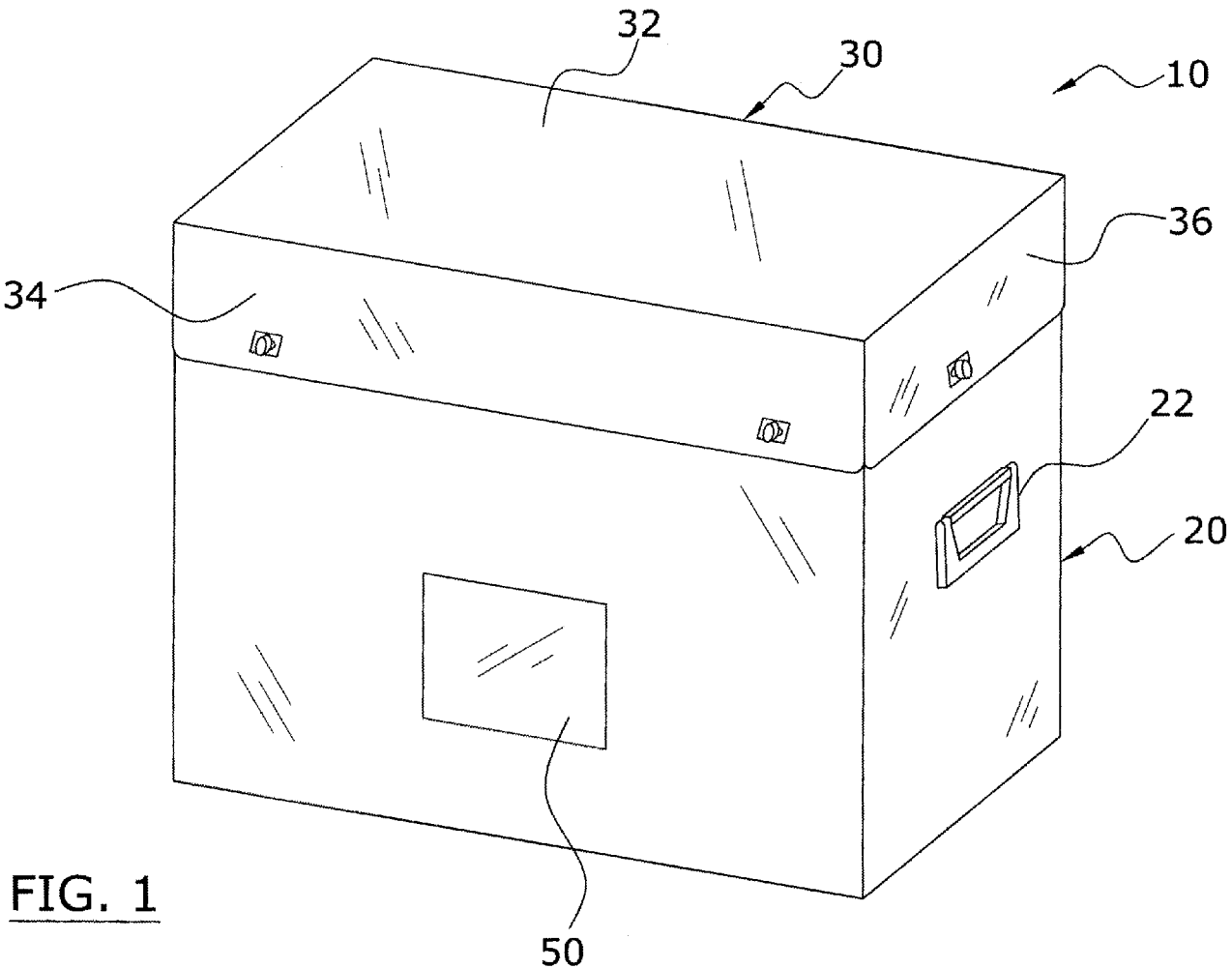
FIG. 1 is an upper perspective view of the present invention.
Figure 2:
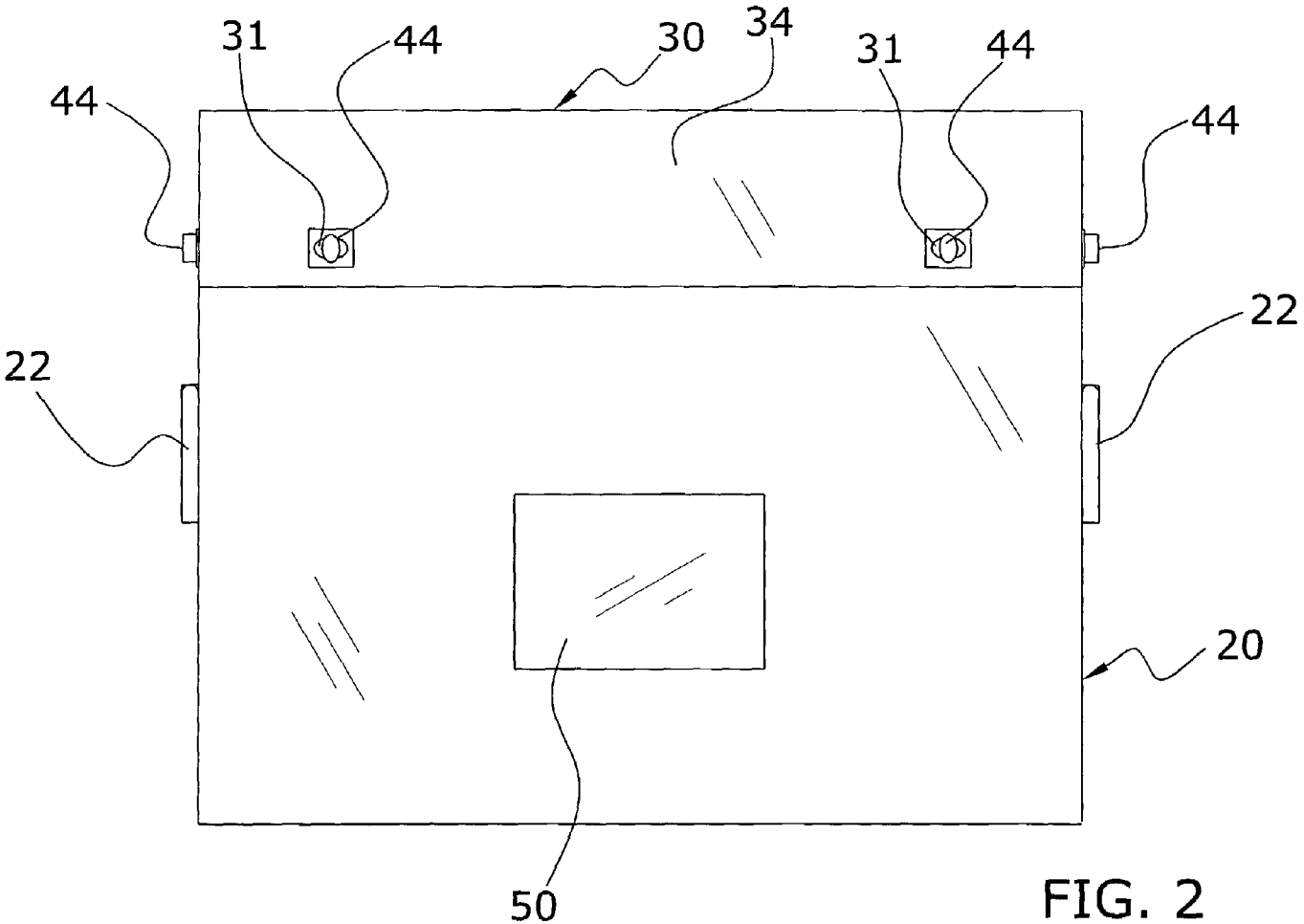
FIG. 2 is a front view of the present invention.

Turning now descriptively to the drawings, in which similar reference characters denote similar elements throughout the several views, FIGS. 1 through 7 illustrate a school document storage system 10, which comprises an outer housing 20 having a cover member 30, and a plurality of inner compartments 60 removably positioned within an interior of the outer housing 20. A transparent pocket 50 is preferably positioned within the front portion of the outer housing 20 for receiving a picture or other display item. A plurality of closure apertures 31 are within the cover member 30 that removably receive closure members 40 attached to the upper sides of the outer housing 20. The cover member 30 preferably has an upper member 32, a front member 34 extending from the upper member 32 and a pair of side members extending from the upper member 32.

B. Outer Housing

FIGS. 1 through 4 illustrate the outer housing 20 having an interior portion. The outer housing 20 is preferably comprised of a material that prevents ultraviolet light from entering the contents of the outer housing 20. In addition, the outer housing 20 is preferably comprised of a material that is impermeable to water and debris.

The outer housing 20 has an upper opening 24 for allowing insertion and removal of a plurality of inner compartments 60. The outer housing 20 preferably includes a front cutout 26 for assisting in providing easy access to the inner compartments 60 within the outer housing 20. The outer housing 20 may have various shapes, however it is preferable to have a rectangular upper opening 24 that reflects the cross section of the outer housing 20 as shown in FIGS. 1 through 4 of the drawings.

A cover member 30 is attached to the outer housing 20 for selectively closing the upper opening 24. The cover member 30 may be attached to the outer housing 20 via various methods including pivotal, removable and the like. The cover member 30 includes a plurality of closure apertures 31 as best shown in FIGS. 3 and 4 of the drawings.

A plurality of closure members 40 are attached to the outer housing 20, wherein said closure members 40 are catchably received within said closure apertures 31. The closure apertures 31 are preferably positioned within the front member 34, the first side member 36 and the second side member 38 of the cover member 30. The closure members 40 may be comprised of various closure devices such as but not limited to twist closures, buttons, hook and loop fastener and the like.

Figure 3:
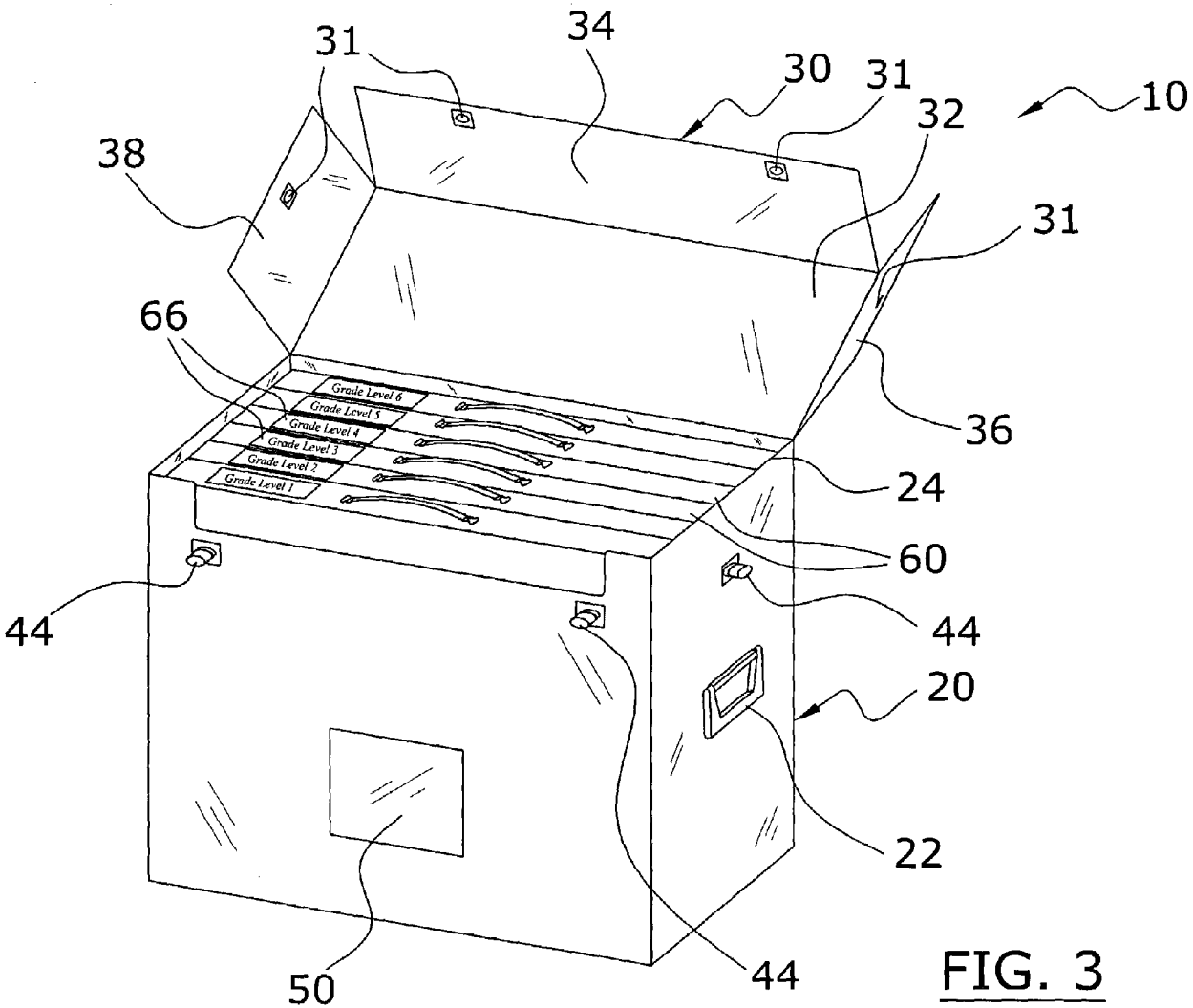
FIG. 3 is an upper perspective view of the present invention with the cover member opened.
Figure 4:
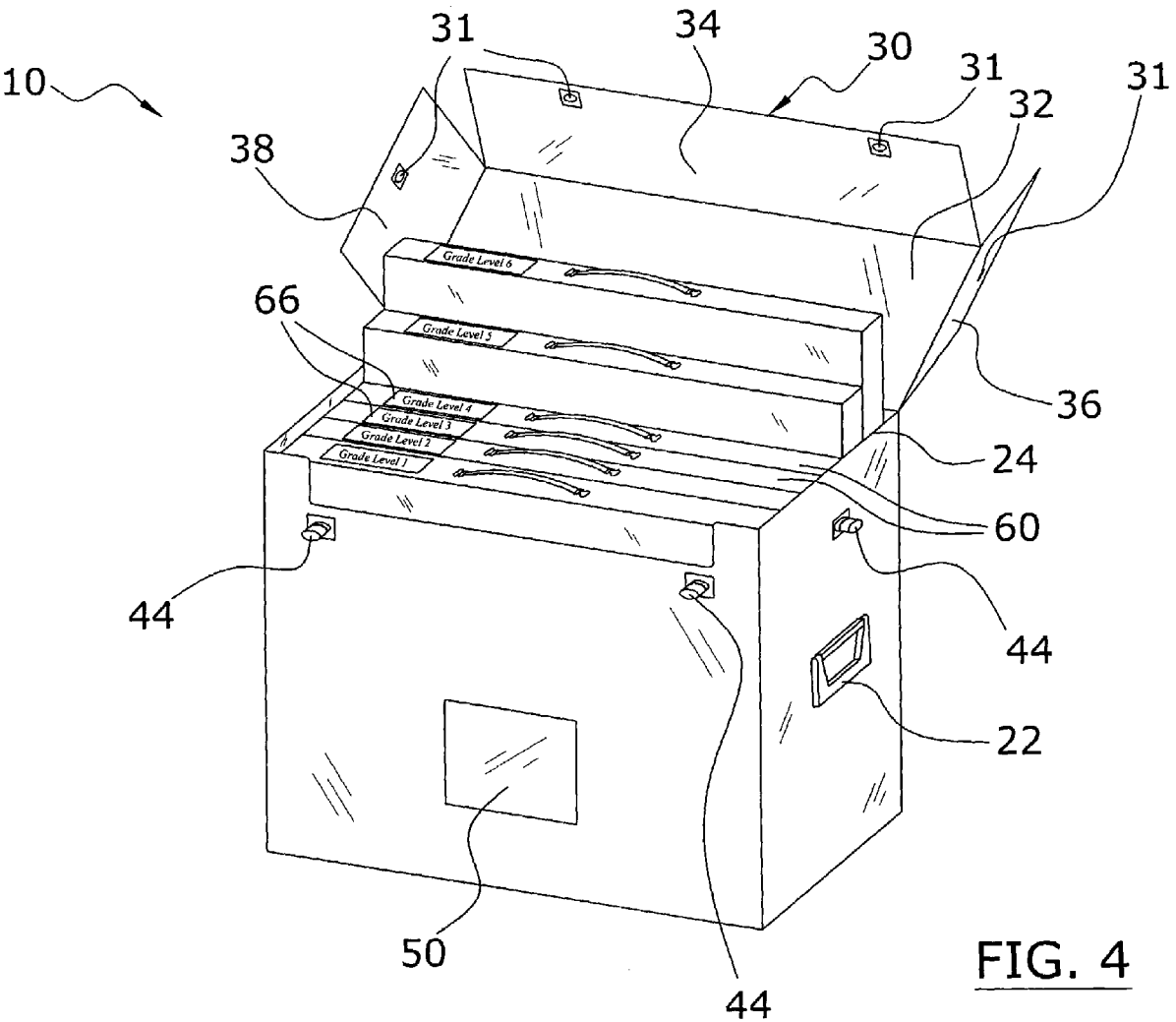
FIG. 4 is an upper perspective view of the present invention with the inner compartments partially removed.

As shown in FIGS. 3 and 4 of the drawings, the cover member 30 preferably has an upper member 32, a front member 34 extending from the upper member 32, a first side member 36 extending from the upper member 32, and a second side member 38 extending from the upper member 32 opposite of the first side member 36. The front member 34, the first side member 36 and the second side member 38 are preferably pivotally attached to the upper member 32. As shown in FIGS. 1, 3 and 4 of the drawings, the upper member 32 has a rectangular shape, however various other shapes may be utilized to form the upper member 32 corresponding to the upper opening 24 of the outer housing 20.

As shown in FIGS. 1 through 4 of the drawings, a pair of outer handles 22 are attached to opposing sides of the outer housing 20. The outer handles 22 are preferably pivotally attached, however various other connections may be utilized.

C. Inner Compartments

Figure 5:
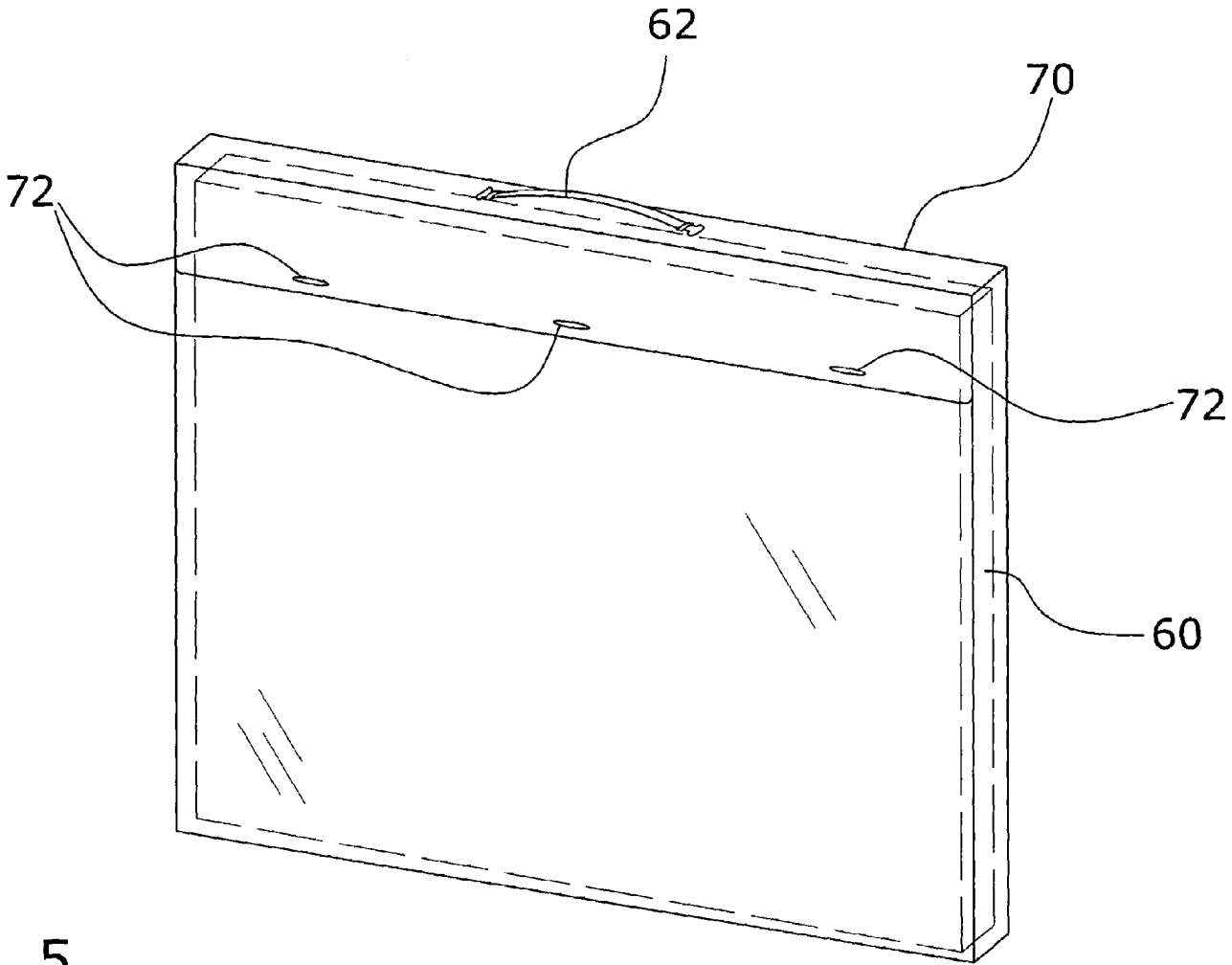
FIG. 5 is an upper perspective view of an inner compartment in a closed state.
Figure 7:
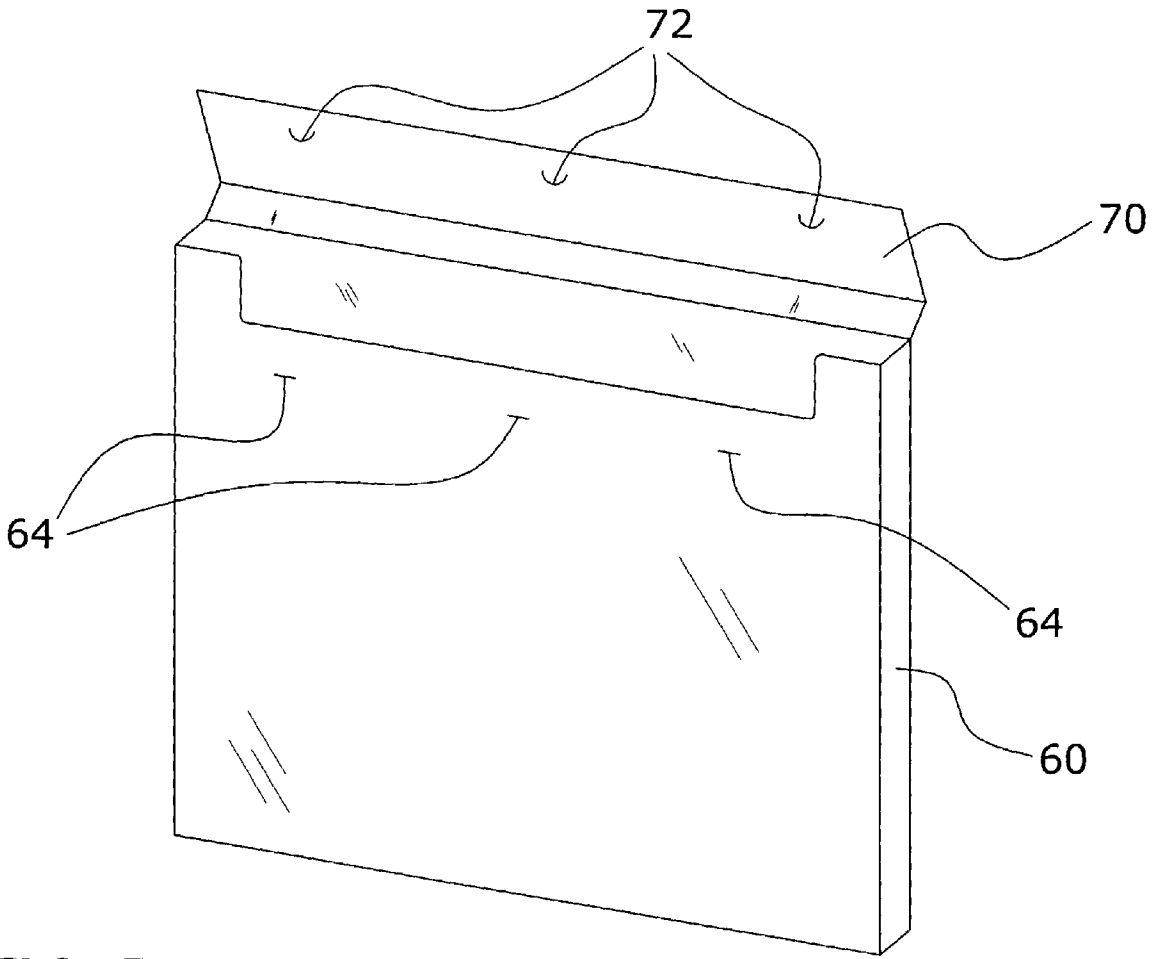
FIG. 7 is an upper perspective view of an inner compartment in a fully open state.

As shown in FIGS. 3 and 7 of the drawings, a plurality of inner compartments 60 are removably positioned within an interior of the outer housing 20. Each of the inner compartments 60 is capable of storing a grade level of school documents 12 such as artwork, schoolwork, report cards, awards and the like. The inner compartments 60 are preferably comprised of a resilient, water impermeable and ultraviolet light protective material to protect the school documents 12 within. Each of the inner compartments 60 preferably includes an inner handle 62 as shown in FIGS. 3 through 5 of the drawings.

As further shown in FIGS. 3 and 4 of the drawings, the inner compartments 60 are preferably comprised of at least 6 inner compartments 60 that are positioned substantially parallel to one another within the interior of the outer housing 20. Each of the inner compartments 60 has a lid 70 for providing access and protection to the school documents 12 within.

Figure 6:
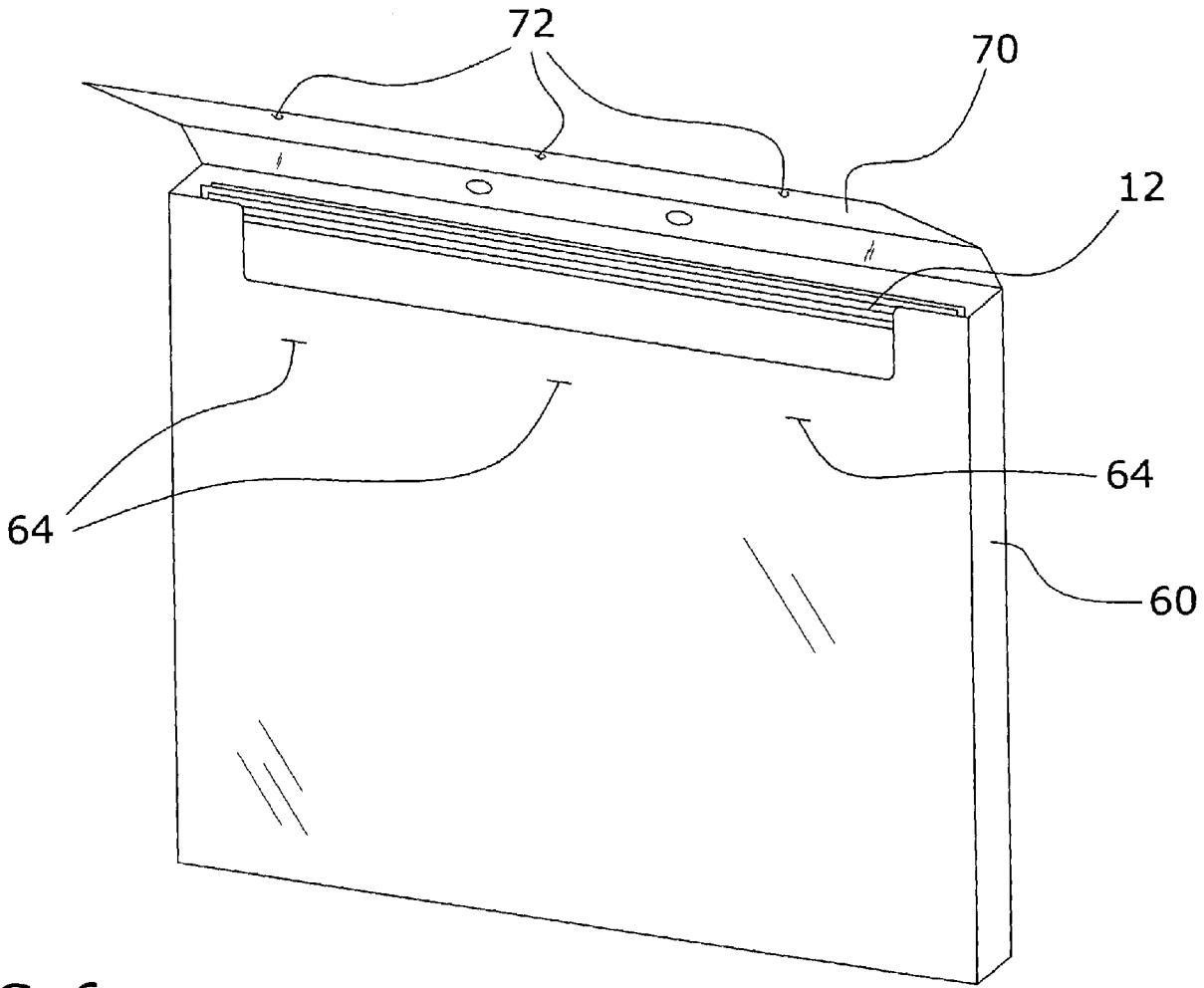
FIG. 6 is an upper perspective view of an inner compartment in a partially open state.

The lid 70 preferably includes a plurality of engaging members 72 that selectively engage a corresponding plurality of slits 64 within the inner compartments 60 as shown in FIGS. 6 and 7 of the drawings. Various other fastener devices may be utilized for selectively closing the lid 70 of the inner compartments 60.

As shown in FIGS. 3 and 4 of the drawings, a plurality of labels 66 are attached to the inner compartments 60 indicating what grade level of school documents 12 are to be retained within each of the inner compartments 60. The labels 66 each have indicia that indicate the grade level (or plurality of grade levels) that each particular inner compartment 60 represents. In addition, the grade level may be printed/written directly upon the inner compartment 60.

The labels 66 may be preprinted with the grade levels or have a blank space for the user to write the grade level upon.

For example, the first inner compartment 60 may store school documents 12 for a student for pre-kindergarten to kindergarten. The second compartment 60 may store school documents 12 for $1^{st}$ and $2^{nd}$ grades. The third compartment 60 may store school documents 12 for $3^{rd}$ and $4^{th}$ grades. The process continues until the child leaves high school (though expansion into college may also be utilized).

D. Pocket

As shown in FIGS. 1 through 4 of the drawings, a transparent pocket 50 is preferably attached within a front portion of the outer housing 20 for receiving a display item (e.g. picture, name tag). The pocket 50 may be formed to receive various sizes and thicknesses of display items. The pocket 50 may be attached to the exterior of the outer housing 20 or within an opening within the outer housing 20.

E. Operation of Invention

When the parent has a school document 12 that requires storage, the parent removes the inner compartment 60 that corresponds to the grade level of the school document 12. The parent opens the inner compartment 60 and inserts the school document 12 into the inner compartment thereafter closing the inner compartment 60. The user then positions the inner compartment 60 back into the outer housing 20 and then closes the cover member 30 to protect the inner compartments 60 and the school documents 12. This process continues as each new school document 12 is received. The above process is repeated if the user desires to review a selected school document 12 from a specific grade level.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A school document storage system, comprising:

an outer housing having an upper opening, a front cutout extending from said upper opening and a cover member for selectively closing said upper opening;

a plurality of inner compartments removably positioned within an interior of said outer housing, wherein each of said inner compartments is capable of storing a grade level of school documents;

wherein each of said inner compartments includes an inner handle;

a transparent pocket attached within a front portion of said outer housing for receiving a display item;

wherein said cover member includes a plurality of closure apertures and a plurality of closure members attached to said outer housing, wherein said closure members are catchably received within said closure apertures;

wherein said cover member preferably has an upper member, a front member extending from said upper member, a first side member extending from said upper member, and a second side member extending from said upper member opposite of said first side member;

wherein said front member, said first side member and said second side member are pivotally attached to said upper member;

wherein said upper member has a rectangular shape;

wherein said outer housing has a rectangular box structure;

wherein said cover member is pivotally attached to said outer housing;

a pair of outer handles attached to opposing sides of said outer housing; and wherein said inner compartments are comprised of at least 6 inner compartments each having lid with a plurality of engaging members that selectively engage a corresponding plurality of slits within said inner compartments; and a plurality of labels attached to said inner compartments indicating what grade level of school documents are to be retained within each of said inner compartments.

* * * * *